US008358191B2

(12) United States Patent
Witzani et al.

(10) Patent No.: US 8,358,191 B2
(45) Date of Patent: Jan. 22, 2013

(54) INDUCTOR AND METHOD FOR PRODUCTION OF AN INDUCTOR CORE UNIT FOR AN INDUCTOR

(75) Inventors: Friedrich Witzani, Munich (DE); Andreas Huber, Maisach (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 24 days.

(21) Appl. No.: 12/865,131

(22) PCT Filed: Nov. 24, 2008

(86) PCT No.: PCT/EP2008/066071

§ 371 (c)(1),
(2), (4) Date: Jul. 29, 2010

(87) PCT Pub. No.: WO2009/095122

PCT Pub. Date: Aug. 6, 2009

(65) Prior Publication Data

US 2010/0328007 A1 Dec. 30, 2010

(30) Foreign Application Priority Data

Jan. 31, 2008 (DE) ..... 10 2008 007 021

(51) Int. Cl.
*H01F 17/06* (2006.01)
*H01F 27/24* (2006.01)

(52) U.S. Cl. ..... 336/178; 336/212; 336/233; 336/219

(58) Field of Classification Search ..... 336/178, 336/214, 160, 165, 134, 212, 221, 219, 184, 336/233, 234; 29/602.1
See application file for complete search history.

(56) References Cited

U.S. PATENT DOCUMENTS

| | | | | | |
|---|---|---|---|---|---|
| 2,221,983 | A | * | 11/1940 | Mayer et al. | 428/213 |
| 3,028,570 | A | * | 4/1962 | Taylor | 336/83 |
| 3,195,086 | A | * | 7/1965 | Taylor | 336/83 |
| 3,390,364 | A | * | 6/1968 | Russell | 336/110 |
| 4,030,058 | A | * | 6/1977 | Riffe et al. | 336/92 |
| 5,477,203 | A | * | 12/1995 | Sawazaki et al. | 336/92 |
| 5,719,546 | A | * | 2/1998 | Ito et al. | 336/180 |
| 6,177,855 | B1 | * | 1/2001 | Bouillot et al. | 336/178 |
| 6,696,638 | B2 | | 2/2004 | Esguerra et al. | |

FOREIGN PATENT DOCUMENTS

| | | | |
|---|---|---|---|
| DE | 3611906 | A1 | 10/1987 |
| EP | 0557368 | B1 | 9/1994 |
| EP | 1097463 | B1 | 11/2002 |
| FR | 1364128 | A | 6/1964 |

OTHER PUBLICATIONS

International Search Report of PCT/EP2008/066071 mailed Mar. 30, 2009.
English machine translation for FR 1364128 A.
English abstract for DE 3611906A1.

* cited by examiner

*Primary Examiner* — Mohamad Musleh
*Assistant Examiner* — Mangtin Lian

(57) ABSTRACT

An inductor may include an electrical conductor for generating a magnetic field; and at least one inductor core unit which is arranged in the region of the conductor and includes an inductor core composed of a magnetizable material and also at least one air gap, a filling material being introduced at least into part of the air gap for the purpose of mechanical stabilization, wherein the filling material is configured in such a way that it has a coefficient of thermal expansion, the value of which lies in a range of ±70% of the value of the coefficient of thermal expansion of the magnetizable material of which the inductor core is composed.

7 Claims, 2 Drawing Sheets

INDUCTOR AND METHOD FOR PRODUCTION OF AN INDUCTOR CORE UNIT FOR AN INDUCTOR

RELATED APPLICATIONS

The present application is a national stage entry according to 35 U.S.C. §371 of PCT application No.: PCT/EP2008/066071 filed on Nov. 24, 2008.

TECHNICAL FIELD

Various embodiments relate to an inductor, and to a method for producing an inductor core unit for an inductor.

BACKGROUND

An inductor of this type is known to the person skilled in the art in this case as an inductive component appertaining to electrical engineering and serves, in particular, for storing and rereleasing electrical energy. For this purpose, the inductor includes an electrical conductor for generating a magnetic field and also at least one inductor core unit which is arranged in the region of the electrical conductor and which includes, for its part, an inductor core composed of a magnetizable material. In order to obtain a magnetic flux density of the inductor core that is not excessively high, the inductor core includes at least one air gap, by virtue of which a magnetic saturation of the inductor core occurs only at significantly higher field strengths and excessive heating during the operation of the inductor with AC current is avoided. For the purpose of mechanical stabilization of the inductor core, a filling material is introduced at least into part of the air gap, as a result of which both undesired sound emissions during the operation of the inductor and alterations of the gap width are intended to be avoided. The filling material used for this purpose is usually organic adhesives or silicones, which are firstly introduced into the air gap and subsequently cured therein.

What can be regarded as disadvantageous in this case is the circumstance that, as a result of the temperature changes during the operation of inductors of this type, cracking occurs in the filling material of the gap of the inductor core unit or in the magnetizable material of the inductor core, which as a further consequence entails a significant amplification of the sound emissions in the frequency range audible to humans and also a reduction of the mechanical stability of the inductor core unit. This considerably reduces the operating period of the inductor with low sound emission.

SUMMARY

Various embodiments provide an inductor which allows an increased operating period with low sound emission.

Configurations of the inductor should be regarded as provided by a configuration of the method and, conversely, configurations of the method result in a configuration of the inductor.

An inductor which allows an increased operating period with low sound emission is provided, according to the invention, by virtue of the fact that the filling material of the air gap of the inductor core is embodied in such a way that it has a coefficient of thermal expansion, the value of which lies in a range of ±70% of the value of the coefficient of thermal expansion of the magnetizable material of which the inductor core is composed. In contrast to the prior art, where filling materials having values of the coefficient of thermal expansion which are five to ten times higher than that of the inductor core material are used, the cracking both in the air gap of the inductor core unit of the inductor and in the magnetizable material of the inductor core itself is reliably prevented with the aid of a filling material embodied according to the invention. The temperature fluctuations which arise during relatively long operation of the inductor then lead to a comparable temperature-dependent expansion behavior of the inductor core or of the gap thereof, on the one hand, and of the filling material, on the other hand, such that no cracks or mechanical damage occur and the operating period and lifetime of the inductor are considerably lengthened. Alongside the cost advantages which can be achieved as a result, it is additionally ensured that disturbing sound emissions at frequencies audible to humans do not occur in the course of the operation of the inductor.

In one advantageous configuration of the invention it is provided that the filling material is embodied in such a way that it has a coefficient of thermal expansion, the value of which lies in a range of ±50% and/or in a range of ±40% and/or in a range of ±25% and/or in a range of ±10% of the value of the coefficient of thermal expansion of the magnetizable material of which the inductor core is composed. By virtue of a filling material embodied in this way, the temperature-dependent expansion behavior of the material pairing filling material/inductor core material is matched further, as a result of which the operating period of the inductor with low sound emission is additionally increased. With the aid of a filling material having a value of the coefficient of thermal expansion which is increased between 10% and 50% in comparison with that of the magnetizable material of the inductor core, a targeted mechanical prestress of the inductor core can advantageously be produced as the temperature rises, as a result of which the mechanical vibratability of the inductor core unit and hence the resulting sound emissions are additionally reduced.

The choice of material for the inductor core includes at least one type of ferrite and/or an iron powder and/or a molypermalloy powder and/or a nanocrystalline magnetic material. These materials allow a flexible configuration—optimally adaptable to the respective purpose of use—of the inductor core or of the inductor core unit taking account of the production costs and the required parameters of inductance, permeability and saturation flux density. The inductor can thus be embodied, for example, as a resonance, step-controller or lamp inductor for electronic ballasts.

In a further advantageous configuration of the invention it is provided that the electrical conductor is wound onto a coil former, preferably wound multiply. The inductance of the inductor can thus be adapted to the respective purpose of use simply and cost-effectively by varying the number of turns of the electrical conductor.

In this case, it has furthermore been found to be advantageous if the filling material comprises an inorganic binder. By way of example, cements, oxides or gels can be used as the inorganic binder. Binders of this type are particularly cost-effective and usually have coefficients of thermal expansion with values that lie in the range desired for the invention for the inductor core materials. Furthermore, under normal conditions they are stable in volume and also water-, acid- and oxidation-resistant, as a result of which a correspondingly long lifetime of the inductor is guaranteed. Furthermore, in the non-cured state, they have the advantage of high flowability, which leads to facilitated introduction of the filling material into the air gap and also to high homogeneity and high dimensional accuracy of the inductor core. By virtue of the filling material hardness that can be achieved, moreover, mechanical or acoustic vibrations of the inductor or of the inductor core are reliably prevented.

In a further advantageous configuration of the invention it is provided that the inorganic binder includes at least one type of water-hardened cement. The latter can be introduced into the air gap in a particularly simple manner in pasty form by addition of water and then sets independently in air. The inductor can be produced particularly simply and cost-effectively in this way. A filling material of this type additionally affords the advantages of odorlessness, a high thermal stability and stability in respect of temperature change, a low toxicity and also a chemical stability with respect to oils, solvents and most organic and inorganic acids.

In this case, in a further configuration it has been found to be advantageous that the cement includes a silicate, preferably zirconium silicate and/or sodium silicate and/or calcium silicate, and/or an oxide, preferably silicon dioxide and/or magnesium oxide and/or aluminum oxide and/or iron oxide and/or calcium oxide, and/or a hydroxide, preferably calcium hydroxide, and/or a sulfate, preferably calcium sulfate and/or comprises a phosphate, preferably magnesium phosphate. When these materials are used, the mechanical and chemical properties of the cement can be optimally adapted to the production and use conditions of the inductor.

A further aspect of the invention provides a method for producing an inductor core unit for an inductor, in which an inductor core composed of a magnetizable material with at least one air gap is provided and a filling material is introduced at least into part of the air gap for the purpose of mechanical stabilization, wherein it is provided according to the invention that a filling material is chosen which has a coefficient of linear thermal expansion, the value of which lies in a range of ±70% of the value of the coefficient of thermal expansion of the magnetizable material of which the inductor core is composed. In this way the cracking in the air gap of the inductor core unit of the inductor or in the magnetizable material of the inductor core is reliably prevented since the temperature fluctuations which arise particularly during relatively long operation of the inductor lead as a result to a comparable temperature-dependent expansion behavior of the inductor core or of the gap and of the filling material. This has the effect that no cracks or mechanical damage occur and the lifetime of the inductor core unit or of the inductor provided therewith is considerably lengthened. Alongside the cost advantages that can be achieved as a result, it is additionally ensured that disturbing sound emissions at frequencies audible to humans do not occur in the course of the operation of the inductor.

It has been found to be advantageous if at least one type of ferrite is used as material of the inductor core and a water-hardenable cement is used as the filling material. With the aid of an inductor core produced from at least one type of ferrite it is possible, on account of the very high permeability values, to achieve correspondingly high inductances of the inductor in conjunction with a small structural space requirement. In combination with water-hardenable cement as the filling material, a chemically and mechanically stable material pairing having very similar values of the coefficient of thermal expansion of the individual components is provided, as a result of which possible cracking during the operation of the inductor core unit or breaking of the inductor core is reliably precluded.

In this case, the inductor core unit can be produced particularly rapidly, simply and cost-effectively by the cement firstly being mixed with a predetermined amount of water and subsequently being introduced into the air gap. On account of the good flow properties and meterability of the filling material, the air gap is filled homogeneously without additional processing steps, as a result of which a particularly high mechanical strength is achieved. The subsequent setting of the cement takes place in air.

In this case, it can likewise be provided that the filling material, after being introduced into the air gap, is pressed in the latter. A state in which the air gap is at least approximately completely filled and a correspondingly high mechanical strength and loadability of the inductor core unit are ensured in this way.

In a further configuration, a further increase in the mechanical loadability of the inductor core unit is achieved by virtue of the fact that during the introduction of the filling material or after further processing steps, it is ensured that a force-locking connection is produced between the inductor core and a coil former of the inductor. This can be effected for example by pressing the filling material into the air gap or by compressing the inductor core. In this case, excess filling material spills over, if appropriate, and can be removed in a simple manner.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
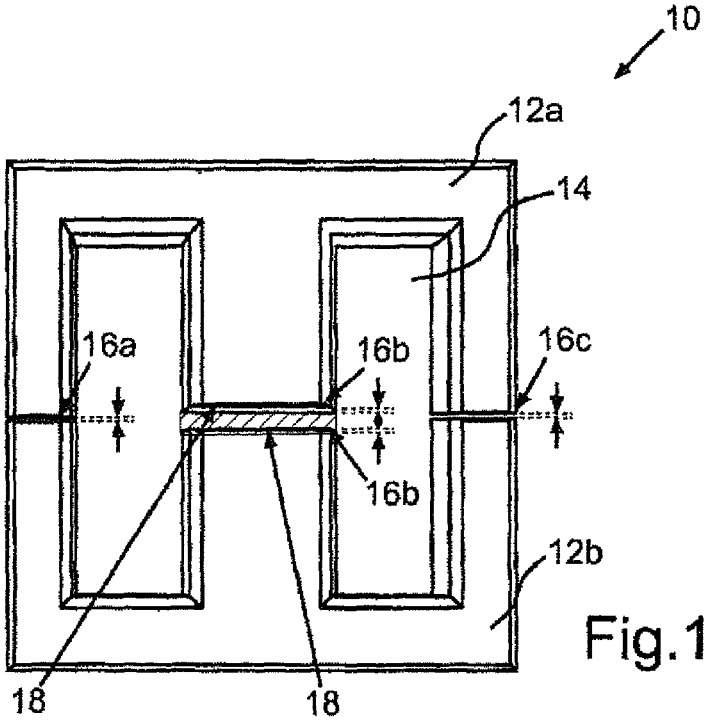
FIG. 1 shows a lateral sectional view of an exemplary embodiment of an inductor core unit for an inductor.

FIG. 1 shows a lateral sectional view of an inductor core unit 10 such as can be used for an inductor. The inductor core unit 10 includes an inductor core 12 composed of two cross-sectionally E-shaped inductor core parts 12*a*, 12*b*. The inductor core parts 12*a*, 12*b* are arranged around a cross-sectionally double-T-shaped coil former 14, which, for its part, serves for increasing an inductance of the inductor if it is wrapped multiply with an electrical conductor (not illustrated). An air gap 16 is situated between the inductor core parts 12*a*, 12*b* and the coil former 14, said air gap having different gap thicknesses in different sections 16*a*-*c*. For the purpose of mechanical stabilization, a filling material 18 is introduced into the section 16*b* of the air gap 16, which forms a central path of the inductor. The sections 16*a*, 16*c* of the air gap 16, which form the outer limbs of the two inductor core parts 12*a*, 12*b* and which have a thickness of between 0.01 mm and 0.05 mm in the present case, are adhesively bonded with an adhesive, as a result of which an additional air gap 16 is produced in the magnetic circuit. In the present exemplary embodiment, the inductor core 12 is produced from a type of ferrite and thereby has a coefficient of thermal expansion $\alpha_D$, the value of which lies approximately in the range of between $11*10^{-6}$/K and $12*10^{-6}$/K. In order to lengthen the operating period and lifetime of the inductor core unit 10 or of the inductor provided therewith, the filling material 18 is embodied in such a way that it has a coefficient of thermal expansion $\alpha_F$, the value of which lies in a range of ±70% of the value of the coefficient of thermal expansion $\alpha_D$ of the material of the inductor core 12. This ensures that temperature fluctuations that occur during the operation of the inductor or of the inductor core unit 10 lead to comparable changes in dimension of the inductor core 12 or of the air gap 16, on the one hand, and of the filling material 18, on the other hand. Cracking and associated production of disturbing noise are avoided as a result. The filling material 18 can include, for example, a zirconium-based, water-hardening cement having a coefficient of thermal expansion $\alpha_F$ having a value of approximately $4.7*10^{-6}$/K. This filling material 18 has a high electrical insulation capability, a high resistance to thermal shock, a high thermal stability and also a high chemical resistance and can be handled without any problems on account of its odorlessness and low toxicity. In principle, most inorganic and silicate-based cement types are suitable as the filling material 18 since these usually have coefficients of thermal expansion $\alpha_F$ having values of between approximately $4.0*10^{-6}$/K and $18.0*10^{-6}$/K.

By way of example, a chemically setting cement including magnesium oxide, zirconium silicate and magnesium phosphate can be used as the filling material 18. In this case, in the cured state, such a filling material 18 likewise has a coefficient of thermal expansion $\alpha_F$ having a value of approximately $4.7*10^{-6}$/K. A chemically setting cement based on quartz and sodium silicate is likewise conceivable as the filling material 18. Depending on the specific configuration, this filling material 18 has a coefficient of thermal expansion $\alpha_F$ having values of between approximately $7.5*10^{-6}$/K and $17.5*10^{-6}$/K and is particularly acid-resistant. In contrast thereto, filling materials 18 that are known from the prior art and include epoxy resins have coefficients of thermal expansion $\alpha_F$ having values of approximately $60*10^{-6}$/K, as a result of which cracking and undesired sound emissions rapidly occur during thermal loading.

In a further embodiment, the filling material is composed of a mixture of 75% by weight of a zirconium cement (e.g. Zircon Potting Cement NO. 13 from Sauereisen, Pittsburgh) and 25% by weight of sand (e.g. Grade 1 [A7-1] sand).

As an alternative, it can be provided that a filling material is used which has a value of the coefficient of thermal expansion $\alpha_F$ which is increased between 10% and 50% in comparison with the value of the coefficient of thermal expansion $\alpha_D$ of the magnetizable material of the inductor core 12. This can be achieved, for example, by a corresponding choice of the filling material 18 or by admixing additional substances having corresponding values of the coefficient of thermal expansion $\alpha_s$ with the filling material 18. As a result of the higher temperature in the central section 16*b* relative to the lateral sections 16*a*, 16*c* of the air gap 16, the filling material 18 thereby expands to a greater extent than the magnetizable material of the inductor core 12 over an equivalent length. This results in a mechanical prestress of the inner region of the inductor core 12 that increases as the temperature rises, as a result of which the mechanical vibratability of the inductor core unit 10 and the resulting sound emissions are additionally reduced.

In order to produce the inductor core unit 10, the respective cement is firstly mixed with the required amount of water, e.g. with 7.5% by weight of distilled water relative to the total weight of the cement, in order to obtain a pasty composition, and introduced into the section 16*b* of the air gap 16. By means of compression of the two inductor core parts 12*a*, 12*b*, a force-locking connection is produced between the inductor core and the coil former 14, such that an assembly that is particularly stable mechanically arises after the cement has cured. During compression, the filling material 18 spills over in the central section 16*b* and at least predominantly fills the air gap 16. Excess filling material 18 can be removed in a simple manner. In order to improve the flow capabilities, additives can optionally be added to the filling material 18.

The curing occurs in three stages: In the first stage, precuring takes place at room temperature for between 10 h and 30 h, then curing takes place at 50° C. for approximately 3 h and, finally, curing takes place at 70° C. for a further approximately 3 h. After cooling, the inductor core unit 10 can then be finally lacquered.

Figure 2:
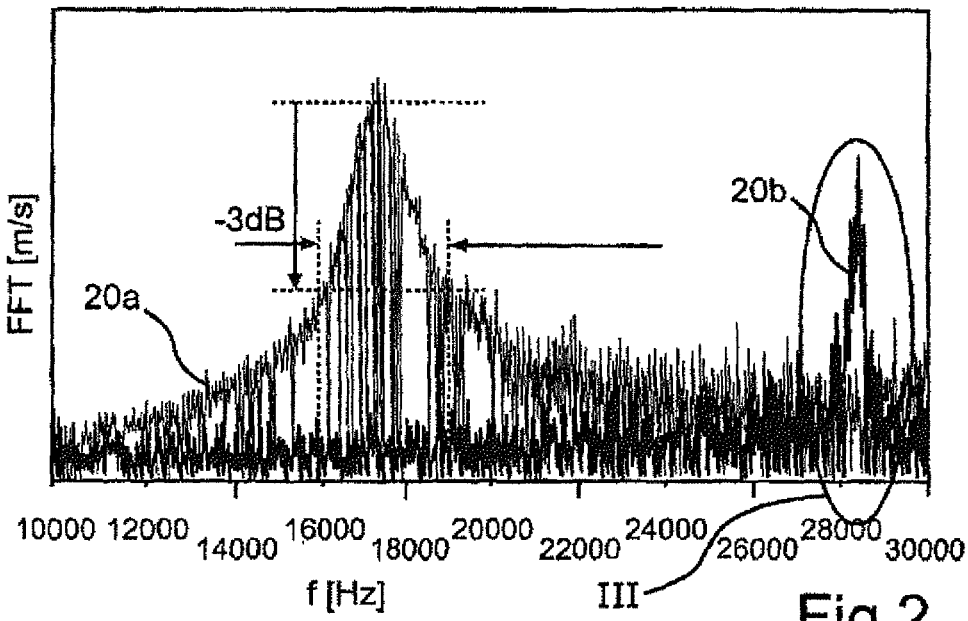
FIG. 2 shows spectra for the excitation frequency-dependent vibrations of two inductors.

FIG. 2 shows two spectra, namely firstly a spectral curve 20*a* representing the intensity of the mechanical vibration as a function of the excitation frequency f, in the case of an inductor without filling material 18 that is known from the prior art. Secondly, FIG. 2 depicts a spectral curve 20*b* representing the intensity of the mechanical vibration as a function of the excitation frequency f, in the case of an inductor provided with the inductor core unit 10 shown in FIG. 1. In both cases, the electrical conductor wound around the coil former 14 is operated with a sinusoidal excitation current with excitation frequencies f of between 10 kHz and 30 kHz. The resulting vibrations FFT of the inductor core 12 with the highest amplitudes in m/s are plotted on the ordinate of the graphs. In this case, it can readily be discerned from FIG. 2 that the spectral curve 20*a* has a peak of the mechanical vibrations particularly in the range of frequencies audible to humans of between 16 kHz and 19 kHz, on account of the low mechanical stability of the air gap 16, as a result of which an intense undesired sound emission is produced. By comparison, the amplitude profile of the spectrum 20*b* exhibits a maximum at approximately 28 kHz to 29 kHz. These vibrations are outside the audible range. The mechanical vibrations of the inductor core unit 10 and hence also the sound pressure level therefore decrease significantly in the audible range in comparison with an inductor provided with an inductor core unit known from the prior art.

Figure 3:
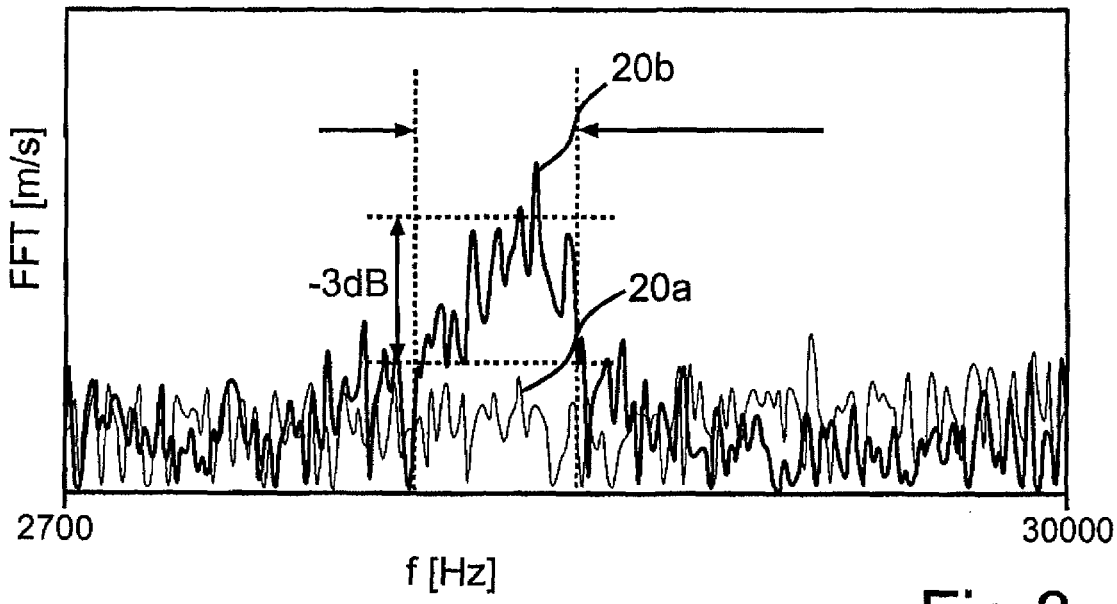
FIG. 3 shows an enlarged view of the region III shown in FIG. 2.

For further illustration of this circumstance, FIG. 3 shows an enlarged view of the diagram region III shown in FIG. 2 at excitation frequencies f of between 27 kHz and 30 kHz.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An inductor, comprising:

at least one inductor core unit and comprises an inductor core composed of a magnetizable material and also at least one air gap, a filling material being introduced at least into part of the air gap for the purpose of mechanical stabilization, wherein the filling material has a coefficient of thermal expansion, the value of which lies in a range of ±70% of the value of the coefficient of thermal expansion of the magnetizable material of which the inductor core is composed, wherein the filling material comprises an inorganic binder, wherein the inorganic binder comprises at least one type of water-hardened cement, wherein the cement comprises at least one material selected from a group consisting of: a silicate; a hydroxide; a sulfate; and a phosphate.

2. The inductor as claimed in claim 1, wherein the filling material has a coefficient of thermal expansion, the value of which lies in a range of ±50% of the value of the coefficient of thermal expansion of the magnetizable material of which the inductor core is composed.

3. The inductor as claimed in claim 1, wherein the magnetizable material of which the inductor core is comprises at least one of at least one type of ferrite; an iron powder; a molypermalloy powder; and a nanocrystalline magnetic material.

4. The inductor as claimed in claim 2, wherein the filling material has a coefficient of thermal expansion, the value of which lies in a range of ±40% of the value of the coefficient of thermal expansion of the magnetizable material of which the inductor core is composed.

5. The inductor as claimed in claim 4, wherein the filling material has a coefficient of thermal expansion, the value of which lies in a range of ±25% of the value of the coefficient of thermal expansion of the magnetizable material of which the inductor core is composed.

6. The inductor as claimed in claim 5, wherein the filling material has a coefficient of thermal expansion, the value of which lies in a range of ±10% of the value of the coefficient of thermal expansion of the magnetizable material of which the inductor core is composed.

7. The inductor as claimed in claim 1, wherein the cement comprises at least one material selected from a group consisting of: zirconium silicate; sodium silicate; calcium silicate; silicon dioxide; magnesium oxide; aluminum oxide; iron oxide; calcium oxide; calcium hydroxide; calcium sulfate; and magnesium phosphate.

* * * * *